US005887523A

United States Patent [19]

Leader, Jr. et al.

[11] Patent Number: 5,887,523

[45] Date of Patent: Mar. 30, 1999

[54] PRINTING PLATE MOUNTING STRUCTURE

[75] Inventors: Charles B. Leader, Jr.; Chad E. Cox, both of Napoleon; Gary L. Hammitt, Toledo, all of Ohio

[73] Assignee: Leader Engineering-Fabrication, Inc., Napoleon, Ohio

[21] Appl. No.: 179,352

[22] Filed: Oct. 20, 1998

Related U.S. Application Data

[60] Provisional application No. 60/015,748 Apr. 22, 1996.

[51] Int. Cl.[6] ..... B41F 27/00

[52] U.S. Cl. ..... 101/382.1; 101/477; 33/621

[58] Field of Search ..... 33/614, 617, 621; 101/378, 382.1, 383, 389.1, 415.1, 477, DIG. 36

[56] References Cited

U.S. PATENT DOCUMENTS

| | | | |
|---|---|---|---|
| 4,018,528 | 4/1977 | Dennis | 355/77 |
| 4,611,539 | 9/1986 | Ireton | 101/415.1 |
| 4,705,590 | 11/1987 | Vandenberg | 101/415.1 |
| 4,925,506 | 5/1990 | Baker | 101/415.1 |
| 5,065,677 | 11/1991 | Leader, Jr. | 101/415.1 |
| 5,132,911 | 7/1992 | Leader, Jr. et al. | 33/621 |
| 5,377,590 | 1/1995 | Bolza-Schiinemann et al. | 101/382.1 |
| 5,488,781 | 2/1996 | Van Der Horst | 33/617 |

*Primary Examiner*—Ren Yan
*Attorney, Agent, or Firm*—Donald R. Fraser

[57] ABSTRACT

An apparatus for mounting flexible printing plates on a printing cylinder includes a base rotatably supporting a printing cylinder in a predetermined position and support having a turntable for supporting a flexible printing plate having a reference point thereon and a front plate support mounted adjacent the front of the turntable. Means for selectively moving front plate support and an associated pressure roll toward and away from the turntable to facilitate the application of the flexible printing plate onto the printing cylinder in a predetermined position.

16 Claims, 5 Drawing Sheets

PRINTING PLATE MOUNTING STRUCTURE

This application is a continuation of PCT/US97/06735 filed Apr. 18, 1997, and a provisional application Ser. No. 60/015,748 filed Apr. 22, 1996.

BACKGROUND OF THE INVENTION

The present invention relates generally to an apparatus for mounting printing plates and, in particular to an apparatus for mounting flexible printing plates on printing press cylinders.

In one form of the printing process, printing is effected by photopolymer or rubber printing plates mounted on printing press cylinders, the paper to be printed being impressed on the inked printing plate. Plate-mounting, color registration and proofing are effected off the press by means of commercially available specially designed mounting-proofing machines.

The mounting of photopolymer or other printing plates onto printing press plate cylinders for printing therefrom requires a high degree of accuracy in the alignment thereof. The image must be square and in register on the plate cylinder in order to print square and in register on the work. In the printing of colors or in the superimpression of images, the various colors or images are added sequentially. Accordingly, it is important that the printing plate which is adding the successive color or image be synchronized with the preceding plate or plates so that the colors or images are accurately superimposed. To arrange these plates in the exact predetermined relation to one another requires that their angular as well as their transverse position on the printing plate support means be accurately determined. In the prior art this synchronizing has been performed by mechanical methods and apparatus which are complicated in implementation and easily subject to inaccuracies. In addition, in the past the synchronizing of the printing plates has been done while they were in position in the printing press. This is not only inconvenient and presents difficult working conditions, but also the printing press is out of operation during this time.

One common method to effect the alignment of the plates with respect to the print cylinder involves the drawing of a line around the printing press cylinder. This line is then aligned by eye with a longitudinal line along the length of the photopolymer or other print plate. This method is relatively accurate but can be extremely time consuming for the operation. This leads to delay between print runs and is costly with respect to the time lost between such runs.

Alternatively, there is commercially available a device to aid in the alignment of photopolymer or printing plates onto the print cylinder. The printing press cylinder is placed in a fixed relationship to the device and the plate is laid upside down on a clear glass top stop. By means of a series of mirrors having lines drawn thereon, the plate is aligned relative to the print cylinder. However, this device is also relatively time consuming and the required accuracy is not achieved. There is only a one-to-one relationship between the eye of the operator and the device assisting in the alignment which can lead to errors of up to one millimeter. These errors are unacceptable where accurate printing is required. This device is generally only acceptable for the alignment of printing plates with respect to one another rather than with respect to the printing press cylinder.

These machines, which usually make use of an optical mounting system, make it possible to mount the printing plates on plate cylinders to effect exact color registration, a procedure essential to the maintenance of both quality and economy in all flexible plate printing operations. Pre-proofing is, in many respects, the most important of all pre-press preparations, for it not only indicates the appearance of the final reproduction, but it also affords means to check the mounting of the plates for color sequence, spacing requirements, layout and gear size, as well as copy and color separation.

Mounting-proofing machines have been provided with a proofing cylinder (sometimes called the impression cylinder) which cooperates with the printing cylinder, the proofing cylinder making contact with the printing plates on the printing cylinder and rotating concurrently therewith to print a proof on a sheet secured to the proofing cylinder. In commercial machines of the type heretofore known which make use of optical mounting techniques, the proofing or impression cylinder is supported for rotation in a fixed position, whereas the printing cylinder is moveable, usually in a vertical direction, from a mounting state in which it is retracted relative to the proofing cylinder to a proofing state in which it is in engagement therewith.

The proofing and printing cylinders are mechanically intercoupled, whereby rotation of the proofing cylinder causes the printing cylinder to rotate. When the diameter of the proofing cylinder is the same as the printing diameter of the printing cylinder (i.e., the diameter of the printing cylinder plus the thickness of the printing plates thereon), then a one-to-one relationship exists therebetween. However, printing cylinders are manufactured in a range of diameters for printing different print lengths. Therefore, it has been necessary to adjust the phase relationship between the printing and proofing cylinders to accommodate the differences between the cylinder diameters. For adjusting this phase relationship for different printing cylinder diameters, a relatively complex mechanism is required in existing types of mounting-proofing machines.

Another drawback of existing types of mounting-proofing machines is their limited capacity to handle printing cylinders of different diameters. With machines of the type heretofore known, the capacity of the machine is restricted to a range of printing cylinder diameters extending from about ninety-five percent of the diameter of the proofing cylinder down to about twenty-five or thirty percent thereof, or approximately four to one. Moreover, since in existing structures, the proof forces imposed at contact are eccentrically opposed, the structures required to accommodate these magnified forces are too large to permit smaller sizes of printing cylinders to fit the machine.

U.S. Pat. Nos. 5,065,677 and 5,132,911 disclose apparatus for mounting and proofing flexible printing plates to an accuracy of plus or minus 0.002 inches along the width and circumference of a printing cylinder. The apparatus mounts the plates on a printing cylinder which is rotatably supported in a predetermined position. An adjacent support table has a surface for supporting a flexible printing plate having a reference point thereon. Actuators move the support table along three orthogonal axes one of which is parallel to the longitudinal axis of the printing cylinder. The position of the reference point is sensed by a video camera and feedback signals representing the positions of the camera and the table with respect to the three axes are inputs to a computer.

The computer determines the positional relationship between the reference point on the printing plate and the predetermined position of the printing cylinder and moves the support table to position the printing plate at a desired position for mounting on the printing cylinder. Each of the actuators includes a drive motor and a motor driver connected between the associated drive motor and the computer. A feedback generator is connected between the drive motor and its associated motor driver for generating the feedback signals to the computer.

The support table has a turntable formed therein for supporting the printing plates and an actuator rotates the turntable about a central axis to position the plate with respect to the printing cylinder. The turntable has a plurality of grooves formed in an upper surface thereof, and a vacuum pump connected to the grooves through a plurality of associated valves and manifold blocks for selectively controlling the application of a vacuum to each of the grooves. The vacuum is applied to the grooves corresponding to the size of the printing plate to retain the plate on the upper surface of the turntable. Each manifold block has an inlet connected to one end of a vacuum supply line and in fluid communication with an elongate outlet passage formed in the block and positioned below the associated groove. The turntable has a plurality of apertures formed between a bottom wall of each groove and a lower surface of the turntable for fluid communication between the outlet passage and the associated groove.

BACKGROUND OF THE INVENTION

The present invention constitutes an improvement over the prior art wherein a method and apparatus is employed to mount a printing plate on a printing press cylinder in an exact and repeatable manner.

More specifically, the invention employs a means for mounting a printing press cylinder in a position assuring axial and circumferential alignment thereof.

The printing plate image information retrieved from the art department is entered into a mounter computer to ensure that printing plates will not overlap when printing two around and two across on a printing press cylinder. The printing plates are provided with microdots located on the X and Y axis in relationship to the edge thereof to allow the associated mounter to properly index the supporting table and the printing press cylinder for mounting plates.

The full plate length, including the non-printing area, is identified in order to determine the amount of rotation of the cylinders requirements for full mounting of the printing plate.

With art designs utilizing more than one set of microdots, due to the small coverages, the location of the multiple sets of microdots as identified in relationship to the main set of dots on both the X and the Y axis.

The microdots on the image are located by a 70X magnification camera to be exposed on an associated TV monitor.

The camera system identifies the shape, size, and location of the microdots with a closed loop to average the inaccuracies of the printing plate on both the X and Y axis of the center line.

A laser gauge is employed to determine the distance from the printing surface to the cylinder center line to within 0.0002 inches. The laser programming is arranged to identify the accuracy of the bare cylinder prior to the mounting of the printing plate thereon.

The laser identifies the variance from pitch line on both the operator's side and the gear side of each plate cylinder and transmits that information to the printing press for the purpose of repositioning each station of the printing press to the actual printing position.

The computer transmits the data from the laser to the press computer so that required plate impressions will be set at start up.

The objects and advantages of the invention may be achieved by an apparatus for mounting flexible printing plates as a printing cylinder comprising means for rotatably supporting a printing cylinder in a predetermined position; a slide support table adjacent the means for rotatably supporting and having a turntable formed therein for supporting a flexible printing plate; means for moving coupled to at least one of the slide support table and the means for rotatably supporting for positioning the turntable of the slide support table at a desired position along at least two of three orthogonal axes relative to the means for rotatably supporting whereby a printing plate on the turntable is located at the desired position relative to the printing cylinder on the means for rotatably supporting; a front plate support mounted in spaced relation to the slide support table for supporting an edge portion of the flexible printing plate; a pressure roll mounted between the slide support table and the front plate support on one side of the edge portion of the flexible printing plate; and means for moving the printing cylinder and the pressure roll toward and away from one another to selectively apply pressure to the edge portion of the flexible printing plate against the printing cylinder.

BRIEF DESCRIPTION OF THE DRAWINGS

Other objects and advantages of the invention will become readily manifest to those skilled in the art from reading the following detailed description of an embodiment of the invention when considered in the light of the attached drawings, in which.

DETAILED DESCRIPTION OF THE PREFERRED EMBODIMENT

Figure 1:
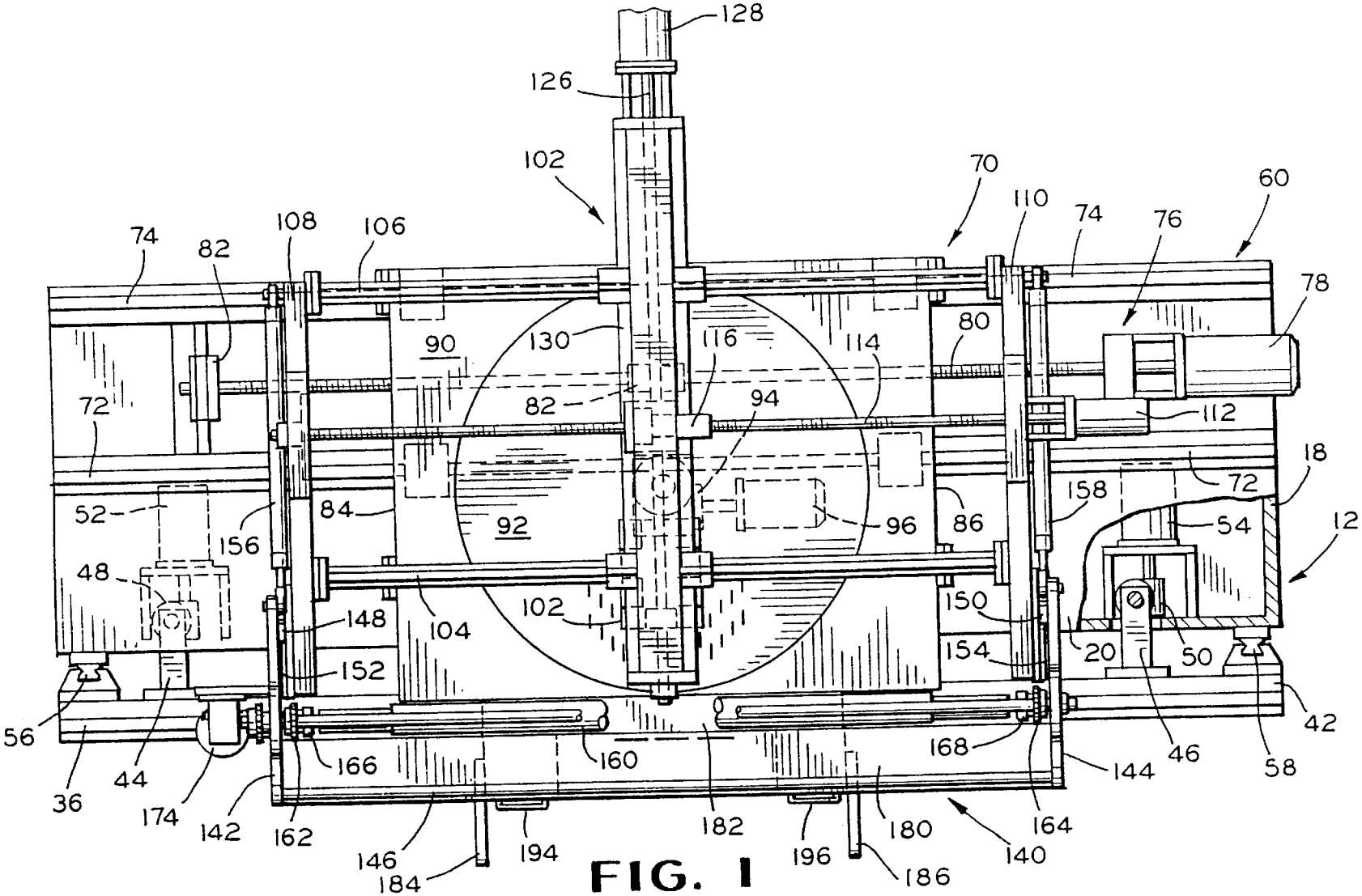
FIG. 1 is a top plan view of a mounting and proofing apparatus in accordance with the present invention.
Figure 2:
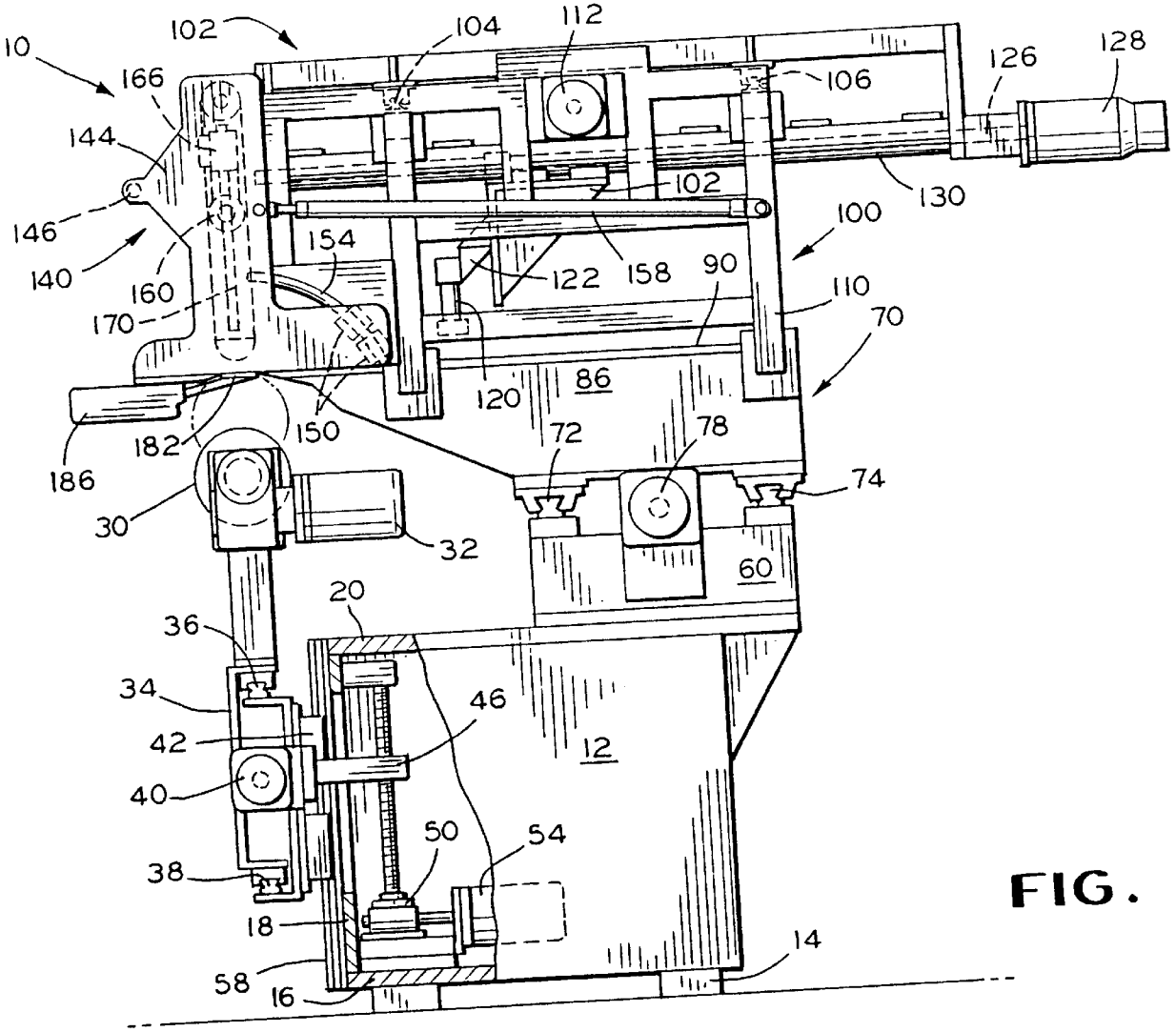
FIG. 2 is a right side elevational view of the apparatus illustrated in FIG. 1 with portions broken away to more clearly illustrate the structure.

Referring to FIG. 1 and 2, there is illustrated a mounting and proofing apparatus, generally indicated by reference numeral 10, for aligning and mounting flexible printing plates on printing cylinders for use on flexographic or rotary presses. The apparatus 10 includes a base support 12 having floor engaging members 14. The base 12 includes a bottom panel 16, upstanding side panels 18, and a top panel 20.

A printing cylinder 30, to which a flexible printing plate is to be mounted, is adjustably mounted to the base 12. The printing cylinder 30 and an associated drive motor 32 (illustrated in FIG. 2) are mounted on a cylinder carriage 34. The upper portion of the carriage 34 is slidably mounted on horizontally extending ways or tracks 36; while the lower portion of the carriage 34 is slidably mounted on horizontally extending spaced apart parallel ways or tracks 38. A cylinder carriage drive mechanism including a drive motor 40 is mounted on the carriage 34. The drive motor 40 is effective to selectively move the carriage 34 horizontally on the horizontally extending tracks 36 and 38 which extend the entire width of the apparatus 10 as illustrated in FIG. 1.

The horizontally extending tracks 36 and 38 are mounted on a supporting frame 42, the opposite end of which are secured to internally threaded blocks 44, 46 respectively of screw jack lifting devices 48, 50 including separate drive motors 52, 54 respectively.

The opposite ends of the frame 42 are provided with vertically extending track members 56, 58 slidably interconnecting the frame 42 to the base 12. It will be understood that the drive motors 52, 54 will effect selective vertical movement of the frame 42 and the associated printing cylinder 30 and the carriage 34.

Therefore, the cylinder carriage drive motor 40 effects horizontal movement of the printing cylinder 30 along an X axis, while the drive motors 52, 54 will effect vertical movement of the frame 42 and the associated cylinder carriage 34 and the printing cylinder 30 along a Y axis.

As illustrated in FIGS. 1 and 2, there is a second support 60 mounted to the upper surface of the top panel 20 of the lower support 12. The second support 60 extends the entire length of the base support 12. A third support 70 is slidingly mounted on the upper surface of the second support 60 on a pair of spaced apart parallel track members 72, 74. The third support 70 can be moved along the X axis relative to the second support 60 by a motor driven ball screw drive 76. Such movement can be accomplished by any suitable actuator coupled between the a second support 60 and the third support 70. In the illustrated embodiment, as most clearly shown in FIG. 1, the motor driven ball screw drive 76 includes an electric motor 78, an output shaft 80, and at least one bearing block 82 for rotatingly supporting the remote end of the drive shaft 80. An internally threaded drive block member 84, to be explained in greater detail hereinafter, is mounted to be driven along the axis of the drive shaft 80.

The third support 70 includes a pair of spaced apart frame members 84, 86. The frame members 84, 86 provide support for the opposing ends of a support table 90. As clearly illustrated in FIG. 1, the table 90 is provided with a generally circular turntable or rotating plate 92 which is suitably mounted in an aperture formed therein. The turntable 92 is attached to the output shaft of an antibacklash gearbox 94 having an input shaft coupled to a turntable drive motor 96. The gearbox 94 and the drive motor 96 are mounted on an underneath surface of the support table 90 for rotating the turntable 92 about the central axis thereof. The turntable 92 includes vacuum means for retaining a flexible printing plate as will be described in greater detail hereinafter.

As illustrated in FIGS. 1 and 2, a frame 100 is attached to and extends upwardly from the third support 70. The frame 100 is provided to support a camera and a pressure roll assembly. Mounted on the frame 100 is a camera carriage 102 which is supported on a pair of spaced apart dovetail slide members 104, 106. The opposite ends of the slide members 104, 106 are suitably secured to spaced apart end members 108, 110, respectively, which are integral with the frame 100. Thus, the camera carriage 102 is moveable with respect to the frame 100 along the same X axis direction of movement as the support table 90. A drive motor 112 is mounted to the frame 100 and coupled to drive a threaded shaft 114 of a ball screw drive 116. The remote end of the threaded shaft 114 is journalled in a bearing block mounted in the end member 108. The ball screw drive 116 is suitably affixed to the camera carriage 102 such that the motor 112 drives the carriage 102 along the X axis in a direction of rotation of the motor 112.

A camera 120 is mounted on the carriage 102 and is directed downwardly toward the upper surface of the upper surface of the turntable 92. The camera 120 is attached to a bracket 122 which in turn is attached to an internally threaded block of a ball screw 124. The block threadably engages a threaded shaft 126 of the ball screw 126 rotatably mounted on the under side of the camera carriage 102. Also, a drive motor 128 is mounted on the camera carriage 102 and is drivingly coupled to the threaded shaft 126. The camera 120 may be a conventional video camera which generates a visual display to a remote camera monitor.

The camera carriage 102 includes a track means 130 on which the bracket 122 is caused to slide. It will be noted from FIGS. 1 and 2 that the track means 130 extend between the front and the rear of the carriage 102. Thus, the drive motor 128 is effective to move the camera 120 along the Y axis depending upon the direction of rotation of the drive motor 128.

Mounted at the front end of the frame 100 is a pressure roll support frame 140. The support frame 140 includes a pair of spaced apart side frame elements 142, 144 coupled together by a transversely extending shaft 146. Bearing blocks 148, 150 are affixed to the facing surfaces of the side frame elements 142, 144, respectively. The bearing blocks 148, 150 are designed to travel on curved rails 152, 154, respectively. The curved rails 152, 154 are affixed to the end members 108, 110, respectively, of the frame 100. The movement of the support frame 140 is further controlled through the use of a pair of dash-pots or motion dampening elements 156, 158. One of the ends of each of the elements 156, 158 is pivotally connected to the frame elements 142, 144, respectively. The other ends of each of the elements 156, 158 is pivotally connected to the end members 108, 110, respectively.

A pressure roll 160 is mounted for reciprocal movement with respect to the side frame elements 142, 144. The ends of the pressure roll 160 are coupled to sprocket and endless chain means 162, 164 by couplings 166, 168, respectively. The couplings 166, 168 are adapted to be slidingly guided within tracks 170, 172 formed in the facing walls of the end elements 142, 144. It will be appreciated that each of the ends of the pressure roll 160 are similarly mounted; however, the motive energy to effect the reciprocal movement of the pressure roll 160 is achieved a drive motor 174. The output shaft of the drive motor 174 is coupled to the sprocket and chain means 162.

The pressure roll support frame 140 includes a laterally extending support plate 180, the innermost edge of which terminates in spaced relation from the outermost edge of the support table 90 forming a gap directly above the rotational axis of the printing cylinder 30. A filler plate 182 is mounted for selective movement into and out of the gap formed between the support plate 108 and support table 90 by linkages mounted at opposite ends to the undersurface of the filler plate 182. Spaced apart slotted brackets 184, 186 are affixed to and depend from the underneath surface of the support plate 180. Each bracket assembly 184, 186 is provided with a linkage arrangement for supporting the end portions of the filler plate 182. Since the linkage arrangements for supporting the filler plate 182 are mirror images of one another, only a single one is illustrated and described in detail.

The linkage arrangement is illustrated in FIGS. 3 to 6, inclusive and includes a generally L-shaped link member 188, one end of which is affixed to the under surface of the filler plate 182 and the opposite end is provided with roller members 190, 192 which are guided in the slots formed in bracket 184. In the retracted position illustrated in FIGS. 5 and 6, the lowermost roller 190 is parked in a recessed front portion of the lowermost slot in the bracket 184. In this position, the filler plate 182 has been retracted to open the gap between the front plate 180 and the support plate 90. The brackets 184, 186 are provided with outwardly extending hand grips 194, 196, respectively. These grips may be grasped by an operator to effect a forward or retracted positioning of the filler plate 182.

Spring biased detents 198, 200 may be employed in the bracket 184 to aid in maintaining the associated bracket in either the forward or the retracted position.

Further, it will be noted that the turntable 92 and the support plate 180 are provided with a plurality of slits S which communicate with a manifold formed in the turntable 92 and a manifold formed in the support plate 180. The manifolds are coupled to a source of vacuum through respective conduits 202, 204. When a printing plate is placed on the upper surface of the turntable 92 and the support plate 180, as illustrated in FIG. 4, suitable solenoids, for example, operating valves to the conduits 202, 204 are actuated to apply a vacuum to the covered ones of the slits S thereby firmly holding the printing plate on the upper surfaces of the turntable 92 and the support plate 180.

At this point, the printing cylinder 30 has been provided with a sticky back adhesive layer 210 which adheres to the outer surface of the printing press cylinder 30 and provides an outer surface capable of securely mounting the printing plate P.

The system for controlling the mounting the printing plate P may satisfactorily include a computer capable of receiving signals representing the positions of the camera 120 of the type generally described in U.S. Pat. No. 5,065,677 which issued Nov. 19, 1991, for example.

Figure 3:
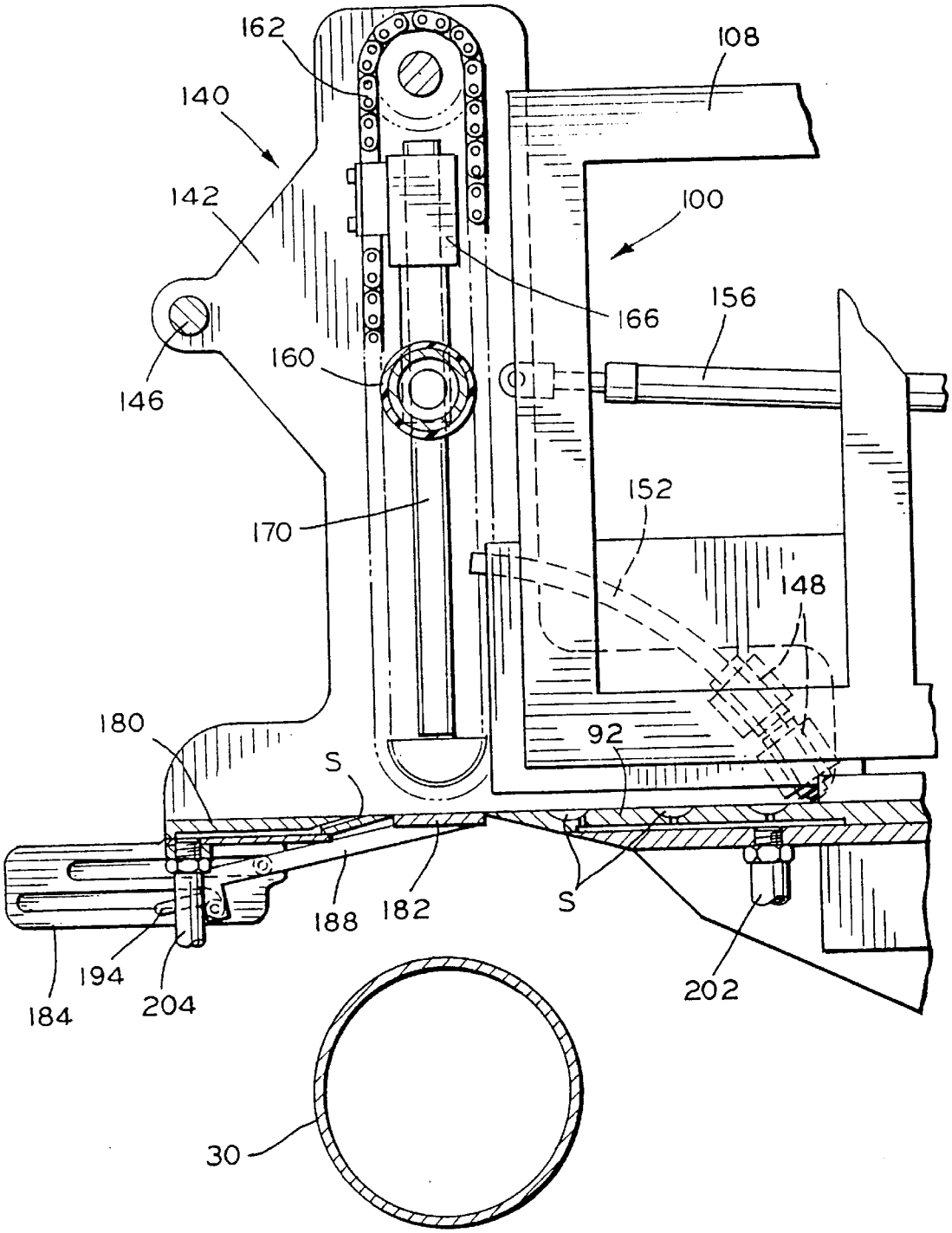
FIG. 3 is an enlarged fragmentary elevational view partially in section illustrating the front support plate, the filler plate, and the associated pressure roll and printing cylinder.
Figure 4:
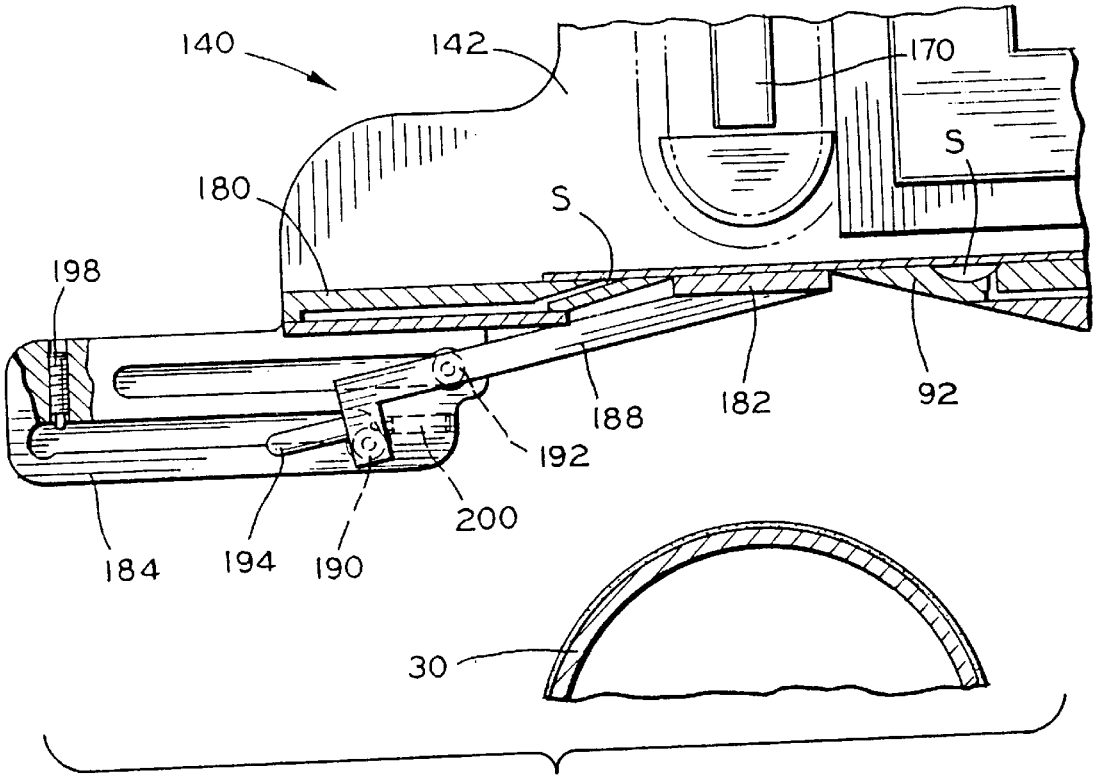
FIG. 4 is an enlarged fragmentary view of the apparatus illustrated in FIG. 3.

Basically, the operation includes the steps of initially positioning the filler plate 182 in the gap between the turntable 92 and the support plate 180 as illustrated in FIGS. 1, 2, 3, and 4. The printing press cylinder 30 is in a lowered position, while the pressure roll 160 is in an elevated position. The printing plate P is then positioned such that the trailing edge is placed near the center line of the turntable 92 and the leading edge approximately one-half inch over the slits S of the front support plate 180 as illustrated in FIG. 4. The vacuum to the slits S is initiated and the camera 120 commences registration. In order to achieve registration it may be necessary to cause rotation of the turntable 92. The vacuum to the slits S of the front plate 180 is inactivated. Once registration is completed, the front support plate vacuum is once again caused to return.

Figure 5:
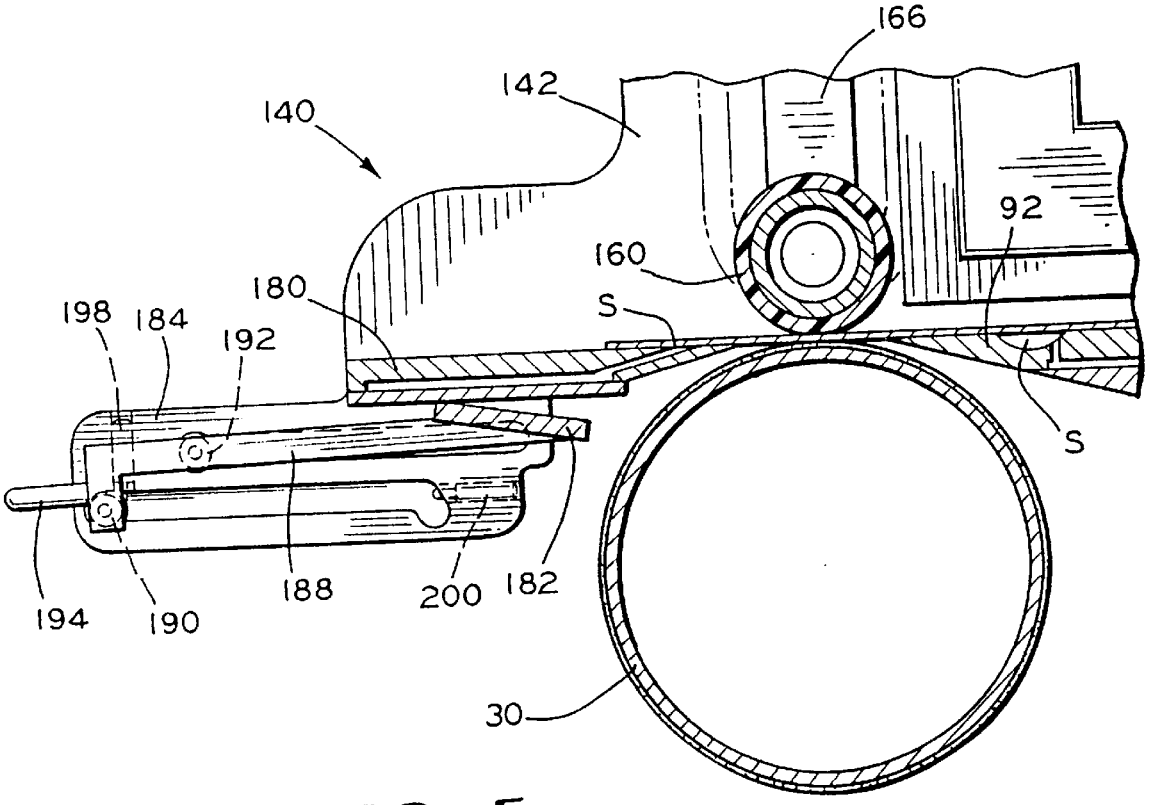
FIG. 5 is a view similar to FIG. 4 showing the removal of the filler plate and the juxtaposition of the pressure roll, printing plate, and the printing cylinder.

The filler plate 182 is then caused to be moved to expose the gap between the turntable 92 and the front support plate 180 as illustrated in FIG. 5. The cylinder 30 is then caused to be driven upwardly to the position illustrated in FIG. 5, while the pressure roll 160 is caused to travel downwardly.

Figure 6:
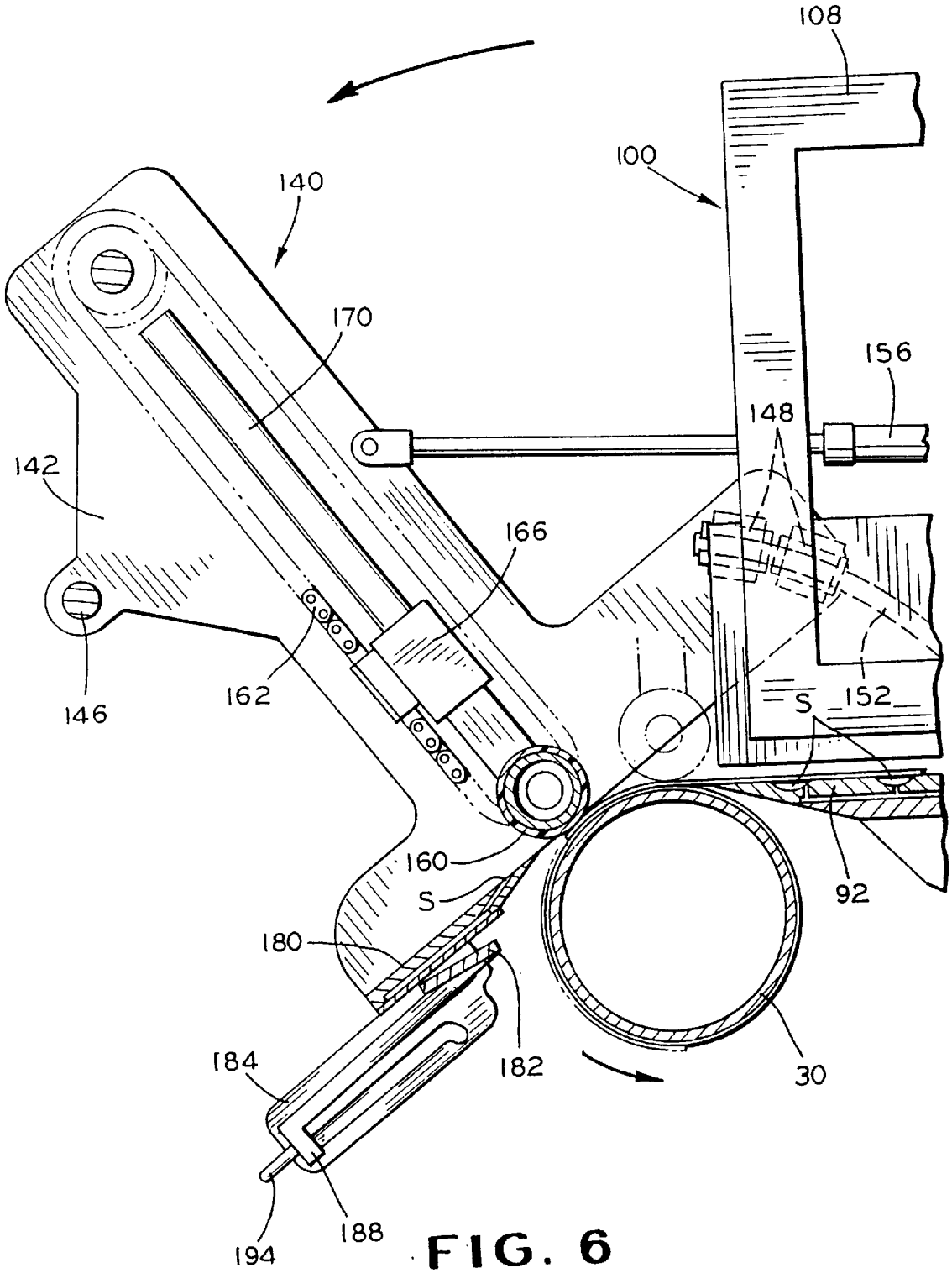
FIG. 6 is an enlarged fragmentary view partially in section showing the pressure roll moved through a radial path to apply the edge portion of the flexible printing plate the adhesive lamina on the outermost surface of the printing cylinder.

When the pressure roll 160 is moved to the position illustrated in FIG. 5, the operator releases the front support plate assembly by grasping the handles 194, 196 and pulling the assembly forward to the position illustrated in FIG. 6. During such arcuate movement of the assembly, the front edge of the printing plate P is transferred from the front plate to the stick, back adhesive layer 210 of the printing press cylinder 30. The cylinder 30 is then caused to e rotated to completely accept the printing plate P.

The front support plate assembly is then returned to the position clearly illustrated in FIG. 3 for final printing plate mounting. Assuming that all of the printing plates have been suitably mounted on the cylinder 30, the pressure roll 160 is caused to be raised and the cylinder 30 is caused to be lowered in preparation for the next cycle.

It will be understood that the operational sequence of the aforedescribed apparatus commences by transferring the necessary computer information from the art department computer concerning the exact location of the required printing plates is suitably fed to the computer controlling the drive motors of the illustrated system. Initially, the printing cylinder 30 is caused to be properly positioned by the drive motors 32, 40, 52, 54; while the camera 120 is caused to be centered over the turntable 92 by the drive motors 112, 128; and the turntable 92 is centered by the drive motors 78, 96.

When the cylinder 30 is generally in the position illustrated in FIG. 2, and the slide table 70 is centered, the support for the printing cylinder 30 is caused to rotate to the starting position and the sticky adhesive layer 210 is ready to be applied to the printing cylinder 30. The cylinder 30 is then raised to a printing plate receiving position and the location may be satisfactorily checked by a laser. In such check, the laser is moved to scan the entire upper or top tangent of the cylinder. This typically is achieved by an associated movement of the slide table 90 which can effectively support the laser. Once the cylinder position is properly checked, the cylinder 30 is moved downwardly and the adhesive layer 210 is applied. The cylinder 30 is now ready for the mounting of the printing plate. After the plate P is mounted to the cylinder 30, as explained in respect of FIGS. 4, 5, and 6 in particular, the cylinder 30 is removed and a new cylinder 30 is inserted and the procedure is duplicated.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. An apparatus for mounting flexible printing plates on a printing press cylinder comprising:

means for rotatably supporting a printing cylinder in a predetermined position;

a slide support table adjacent said means for rotatably supporting and having a turntable formed therein for supporting a flexible printing plate;

means for moving coupled to at least one of said slide support table and said means for rotatably supporting for positioning the turntable of said slide support table at a desired position along at least two of three orthogonal axes relative to said means for rotatably supporting whereby a printing plate on said turntable is located at the desired position relative to the printing cylinder on said means for rotatably supporting;

a front plate support for supporting an edge portion of the flexible printing plate;

a pressure roll;

means for selectively moving said front plate support and said pressure roll toward and away from said slide support table; and means for moving said printing cylinder and said pressure roll toward and away from one another to selectively apply pressure to the edge portion of the flexible printing plate against the printing cylinder as said means for selectively moving said front plate support and said pressure roll moves away from said slide support table.

2. The apparatus defined in claim 1 wherein said means for rotatably supporting a printer cylinder includes an electric motor.

3. The apparatus defined in claim 1 wherein said means for moving coupled to at least one of said slide support table and said means for rotatably supporting including an electric motor.

4. The apparatus defined in claim 1 wherein said means for selectively moving said front plate support and said pressure roll includes an electric motor.

5. The apparatus defined in claim 1 wherein said means for moving said printing cylinder and said pressure roll includes an electric motor.

6. The apparatus defined in claim 2 wherein said electric motor is operative to position the printing cylinder in a position to accept a printing plate.

7. The apparatus defined in claim 6 wherein said means for moving said pressure roll is operative to selectively apply pressure to the printing cylinder supported by said means for rotatably supporting.

8. The apparatus defined in claim 1 wherein said front plate support is coextensive with said slide support table.

9. The apparatus defined in claim 1 wherein said means for moving said printing cylinder and said pressure roll includes means for moving said printing cylinder in the X axis.

10. The apparatus defined in claim 1 wherein said means for moving said printing cylinder and said pressure roll includes means for moving said pressure roll in the Y axis.

11. The apparatus defined in claim 1 including a filler plate interdigitated between said front plate support and said slide support table.

12. The apparatus defined in claim 11 wherein said filling plate, said front plate support and said pressure roll are mounted to a single carriage.

13. The appartus defined in claim 12 wherein said carriage is mounted to move through an arcuate path.

14. The apparatus defined in claim 12 wherein means are provided for guiding movement of said filler plate into and out of interdigitation between said front plate support and said slide support table.

15. The apparatus defined in claim 14 wherein said means for guiding movement of said filler plate includes linkage and slide means.

16. The apparatus defined in claim 15 wherein said means for guiding movement is attached to said carriage.

* * * * *